US006334374B1

(12) United States Patent
Hirse

(10) Patent No.: US 6,334,374 B1
(45) Date of Patent: Jan. 1, 2002

(54) OPEN-END WRENCH

(75) Inventor: Gernot Hirse, Frankfurt am Main (DE)

(73) Assignee: Hirse-Patent-Lizenz-GmbH (DE)

( * ) Notice: Subject to any disclaimer, the term of this patent is extended or adjusted under 35 U.S.C. 154(b) by 0 days.

(21) Appl. No.: 09/600,921

(22) PCT Filed: Nov. 20, 1999

(86) PCT No.: PCT/EP99/08961

§ 371 Date: Sep. 8, 2000

§ 102(e) Date: Sep. 8, 2000

(87) PCT Pub. No.: WO00/30813

PCT Pub. Date: Jun. 2, 2000

(30) Foreign Application Priority Data

Nov. 25, 1998 (DE) ..... 198 54 374

(51) Int. Cl.[7] ..... B25B 13/02
(52) U.S. Cl. ..... 81/119
(58) Field of Search ..... 81/119, 121.1, 81/186

(56) References Cited

U.S. PATENT DOCUMENTS

| | | | | | |
|---|---|---|---|---|---|
| 2,652,753 A | * | 9/1953 | Wilder | ..... | 81/119 |
| 2,671,368 A | | 3/1954 | Diebold | | |
| 3,850,057 A | | 11/1974 | Evans | | |
| 3,868,873 A | * | 3/1975 | Evans | ..... | 81/119 |
| 3,921,476 A | | 11/1975 | Evans | | |

FOREIGN PATENT DOCUMENTS

| | | | | | |
|---|---|---|---|---|---|
| BE | 430 508 | | 10/1938 | | |
| CA | 981069 | * | 1/1976 | ..... | 81/119 |
| CA | 990983 | * | 6/1976 | ..... | 81/119 |
| DE | 1943953 | * | 3/1971 | ..... | 81/119 |
| EP | 0 747 173 | | 12/1996 | | |
| GB | 2 080 171 | | 2/1982 | | |

* cited by examiner

*Primary Examiner*—D. S. Meislin
(74) *Attorney, Agent, or Firm*—Burns, Doane, Swecker & Mathis, LLP

(57) ABSTRACT

An open-end wrench for turning a hexagon object has a wrench head formed by first and second jaws. The first jaw includes a first front impact point. The second jaw includes a second front impact point and an outer impact point spaced forwardly from the second front impact point by a recess disposed in the second jaw. A hexagonal object can be inserted into the wrench in a first orientation wherein first and second parallel surfaces of the object are disposed parallel to the first and second jaws and wherein the first and second front impact points are arranged to contact respective side surfaces of the object at locations spaced by a first distance from a nearest end thereof. After being turned by the wrench, the object is reinserted into the wrench at an orientation offset by 30 degrees from the previous orientation, with a corner of the object disposed in the recess. The first and second front impact points are arranged to contact respective sides of the object at locations spaced by a second distance from the nearest end thereof. The second distance is of the same length as the first distance.

8 Claims, 2 Drawing Sheets

OPEN-END WRENCH

BACKGROUND OF THE INVENTION

The invention relates to an open-end wrench for an hexagon object consisting of a wrench head and a wrench handle.

Different embodied examples of rigid open-end wrenches of this kind are known in the art. In their simplest form with parallel inner jaw surfaces, they are the basic model of a wrench. The customary position of the wrench handle, offset at a 15° angle in relation to the wrench head, allows twisting hexagon objects, in particular nuts and screws, by turning the wrench around after each twisting step, even if the swivel space that is available for the swivel motion of the wrench handle is less than 60°. However, the twisting of the open-end wrench, which is required for this process, increases the labor intensity considerably.

Thus, numerous attempts have been made to develop open-end wrenches that allow grasping hexagon objects with simple changes, i.e. without turning the wrench head around in respective increments of approximately 30°, which means that hexagon objects can be twisted by simple changes in between the individual twisting steps even if less than 60° is available for the swivel motion of the wrench handle. These wrenches have in common, however, that varying impact conditions result for the different point of impact positions on the hexagon object, in particular, upon application of the turning moment, the points of impact are formed at different distances in relation to the respectively adjacent edges of the hexagon object. Thus, depending on the respective point of impact position, different turning moments are transferred to the hexagon object. For example, as a result, in the first point of impact position a comparatively high turning moment can be transferred, but in the next position, offset by approximately 30°, this same turning moment can no longer be transferred causing the wrench head to slip off the hexagon object or causing damage to the hexagon object. In general, this leads to insecurity when handling wrenches of this kind.

The same is also valid for a wrench known in the art (EP 0 747 173 A1) which envisions a recess in one or in both of the diametric wrench surfaces of the two wrench jaws between a front point of impact and a rear point of impact. Said recess accommodates one edge of the hexagon object in one of the two possible point of impact positions that are offset by 30° in relation to each other.

With another wrench known in the art (U.S. Pat. No. 3,921,476) one of the two wrench jaws has an extension and features two outer points of impact on the extended part that are separated from each other by a recess. This rigid wrench known in the art, however, is not conceived for engaging point of impact positions on the same hexagon object that are offset in relation to each other by 30°. Rather, the wrench known in the art is intended to be applied optionally on two hexagon objects of different sizes. A smaller hexagon object is accommodated between the diametric surfaces of the wrench. A larger hexagon object, that does not fit between the two diametric surfaces of the wrench, is received with one of its edges between the two outer points of impact of the one wrench jaw while the rounded outer end on the other wrench jaw is applied in the proximity of the opposite edge of the hexagon object. The point of impact conditions of the open-end wrench are very different for the two sizes of hexagon objects, for which the wrench is envisioned, in particular the respectively effective length of the wrench lever differs. Since the two outer points of impact of the one wrench jaw are protruding in relation to the plane of the allocated inner wrench surface, the open-end wrench can not be applied sideways on the smaller hexagon object. Instead, in the manner of an open ring wrench, it must be pushed axially onto the smaller hexagon object.

Thus, it is the subject-matter of the present invention to provide an open-end wrench featuring approximately the same turning moment transfer conditions in a first point of impact position for both twisting directions as well as in a second point of impact position offset by 30°; furthermore, a wrench is to be provided that can be slipped on from the side and can also be used as a ratchet wrench while having all the advantages of

SUMMARY OF THE INVENTION a simple, rigid open-end wrench in terms of its physical conception. All of these individual tasks must be fulfilled simultaneously by one and the same open-end wrench.

According to the invention this objective is achieved with an open-end wrench for an hexagon object which is equipped with a wrench head and a wrench handle with the diametric surfaces of two wrench jaws forming, respectively, a front point of impact and a rear point of impact. The front point of impact is applied in a first position of the hexagon object on one of two opposite side surfaces of the hexagon object at a predetermined edge distance (a) from the adjacent edge of the hexagon object. In a second position of the hexagon object, twisted by 30°, the front point of impact of one wrench jaw and one outer point of impact, which is located before the front point of impact of the other wrench jaw and separated from the latter by a recess, are also applied, respectively, at the predetermined edge distance (a) from the adjacent edge of the hexagon object.

The two front points of impact are preferably located symmetrically to each other. These front points of impact as well as the additional outer point of impact on the one of the two wrench jaws are, in relation to the respective hexagon object that is to be accommodated, preferably arranged in such a manner that all of them grasp at approximately the same predetermined, optimal edge distance from the adjacent edge of the hexagon object. This means in all point of impact positions a constant edge distance is maintained, which is why approximately the same, highest possible turning moment can be transferred for all point of impact positions. Consequently, the highest possible safety for the handling of the open-end wrench is achieved. The open-end wrench cannot be standardized until this requirement is fulfilled.

According to a preferred embodied example of the invention it is envisioned that the two diametric surfaces have inner jaw surfaces, which are arranged parallel to each other and located respectively between the rear point of impact and the front point of impact. Beyond the respective points of impact, the diametric surfaces recede in relation to the planes of these inner jaw surfaces. Thus, recesses or groves which could weaken the wrench head have been avoided in the area of the parallel inner jaw surfaces. Consequently, it is possible to realize the wrench head with relatively narrow wrench jaws.

BRIEF DESCRIPTION OF THE DRAWINGS

The objects and advantages of the invention will become apparent from the following detailed description of a preferred embodiment thereof in connection with the accompanying drawing in which like numerals designate like elements, and in which.

DETAILED DESCRIPTION OF A PREFERRED EMBODIMENT OF THE INVENTION

Figure 1:
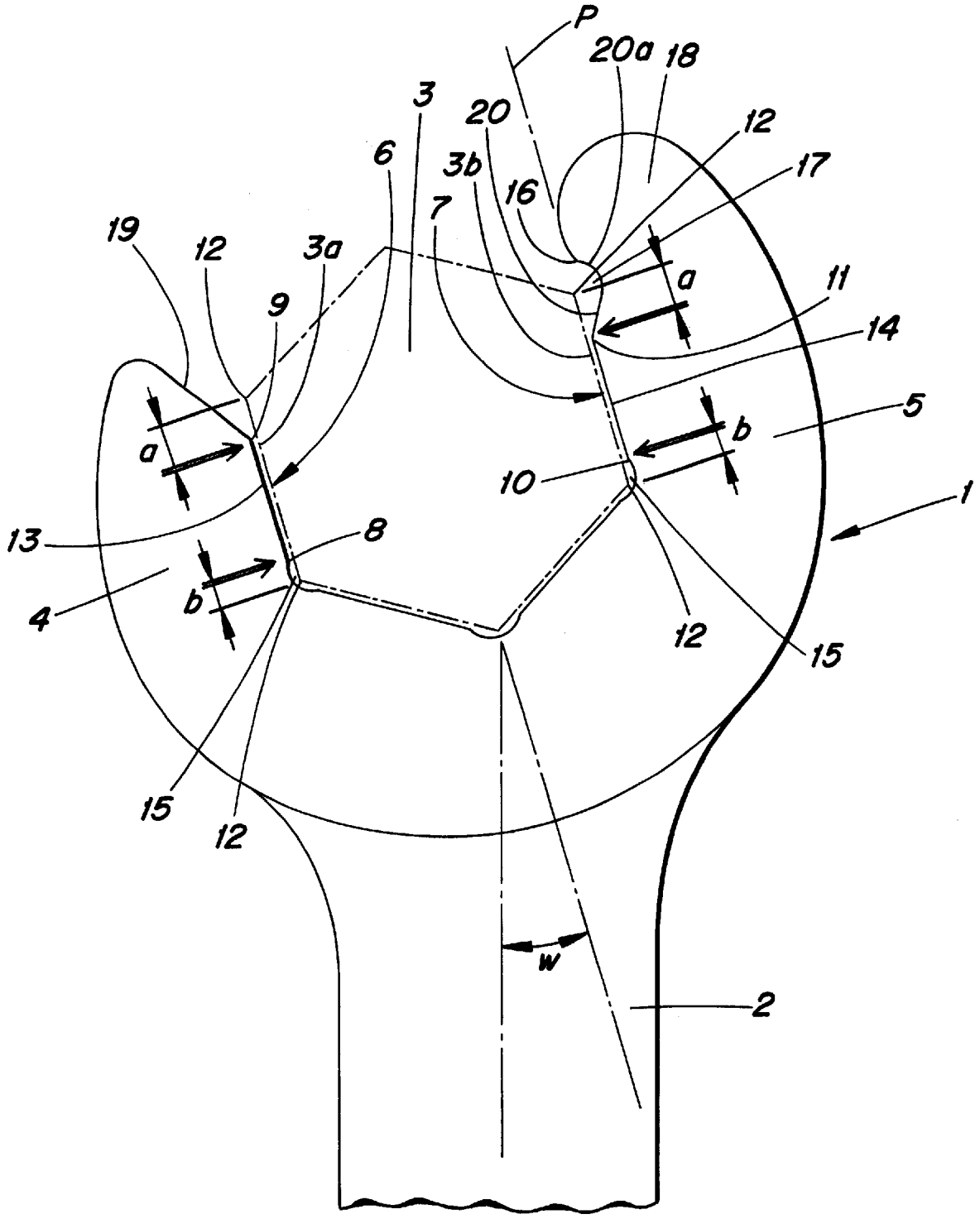
FIG. 1 a wrench head of an open-end wrench in a first point of impact position on an hexagon object, and in FIG. 2 the wrench head of the open-end wrench in accordance with FIG. 1 in a second point of impact position on the hexagon object.

The rigid, one-piece open-end wrench shown in the drawing has a wrench head 1 and a wrench handle 2, with the latter offset at an angle w of approximately 15° in relation to the wrench head 1. The wrench handle 2 can have a second wrench head on its opposite end of another nominal width (not displayed).

The wrench head 1 forms a cavity closed at a rear end and open at a front end to receive the hexagon object 3, e.g. a hex head screw or a hex nut. In the following the realization of first and second wrench jaws 4 and 5 of the wrench head 1 is described essentially in reference to the geometry of the hexagon object that is to be accommodated.

On the diametric surfaces 6 and 7 of the two wrench jaws 4 and 5, respectively, points of impact are realized, which, with a turning moment transfer in the one or the other twisting direction, are applied in the first point of impact position, as shown in FIG. 1, on the side surfaces of the hexagon object 3; in particular, a first rear point of impact 8 and a first front point of impact 9 on the wrench jaw 4 and a second rear point of impact 10 and a second front point of impact 11 on the opposite wrench jaw 5.

As can be seen in FIG. 1, the front points of impact 9, 11 are arranged in relation to the respectively allocated first and second side surfaces 3*a* and 3*b* of the hexagon object in such a way that they are located respectively at a predetermined, equal edge distance a from the adjacent (nearest) edge 12 of the hexagon object 3, which is what places them in a symmetrical position to each other. The back points of impact 8, 10 are located at a edge distance b from the adjacent edge 12.

Between the back and the front points of impact 8, 9 and 10, 11 of the two diametric surfaces 6 and 7 extends, respectively, level (flat) inner jaw surfaces 13, 14. The two inner jaw surfaces 13 and 14 are in a parallel arrangement to each other at a distance that corresponds to the nominal width of the respective wrench jaw taking into account commonly applicable tolerances.

Beyond the points of impact 8–11, respectively, the diametric surfaces of the jaws 6 and 7 recede in relation to the contours of the hexagon object 3. In the area of the two edges 12 that are pointing toward the wrench handle 2 recesses 15 are envisioned on the diametric surfaces 6 and 7.

On the one wrench jaw 5 an outer point of impact 16 is realized before the front point of impact 11 and separated from the front point of impact 11 by the recess 17 on the diametric surface 7 of the wrench. The outer point of impact 16 is realized on a front extension 18 of the one wrench jaw 5. This extension projects toward the received hexagon object 3 no farther than, at most, to the plane P of the inside jaw surface 14 of the allocated wrench jaw 5, which is why it does not interfere with pushing the wrench head 1 onto the hexagon object 3 in the position according to FIG. 1.

Figure 2:
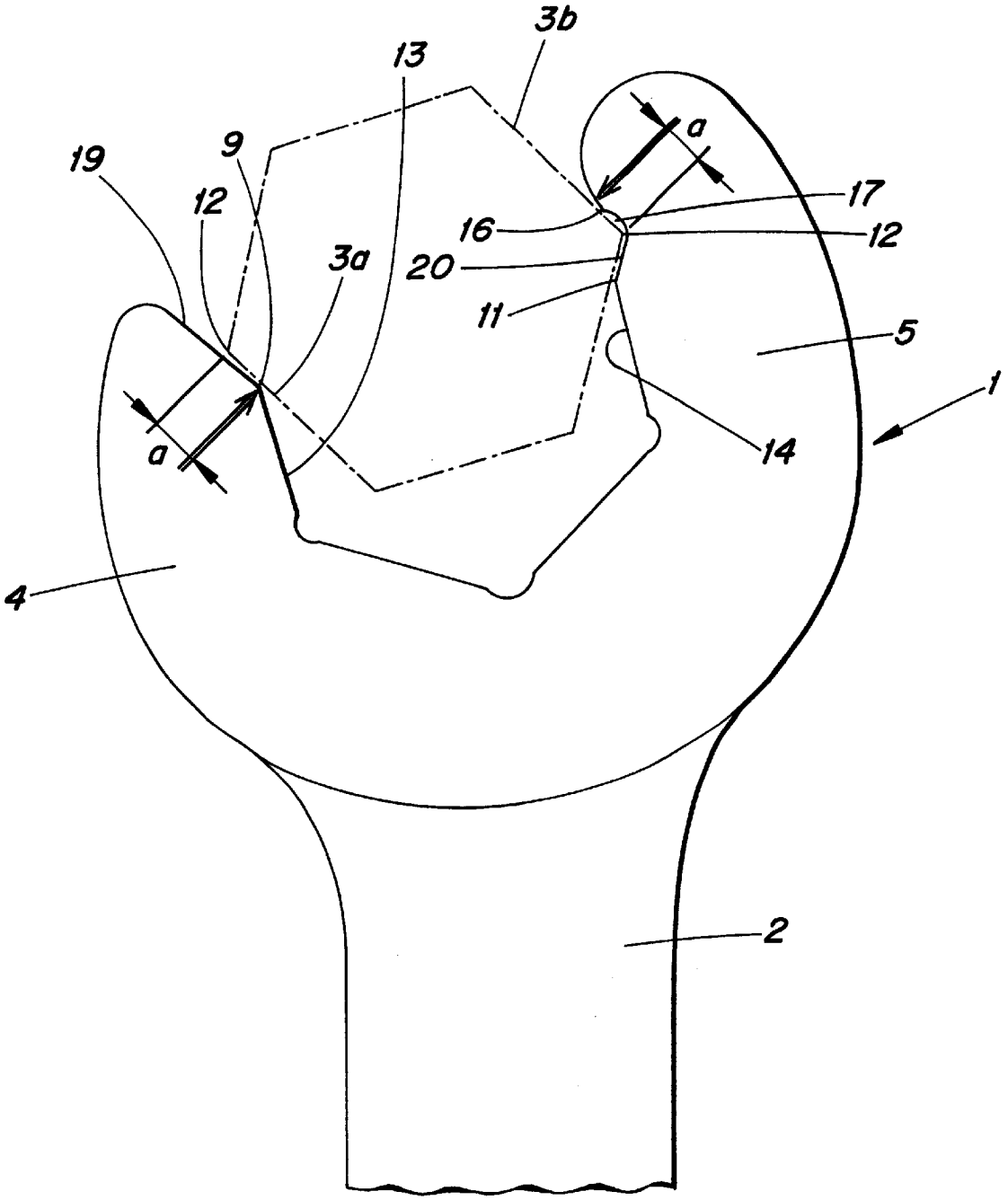

As shown in FIG. 2, in a second point of impact position in which the hexagon object 3 is offset by 30° in relation to the point of impact position in accordance with FIG. 1, the outer point of impact 16 is applied on a side surface 3*b* of the hexagon object 3. Simultaneously, the front point of impact 9 of the opposite wrench jaw 4 is applied on the side surface 3*a*, which is opposite to the side surface 3*b* of the hexagon object 3. The position of the outer point of impact 16 is chosen in such a way that this outer point of impact 16 as well as the front point of impact 9 of the other wrench jaw 4 maintain approximately the same edge distance a to the adjacent edge 12 of the hexagon object 3 as in the point of impact position according to FIG. 1. The one edge 12 is accommodated in the recess 17 of the wrench jaw 5, however without touching it. The wrench jaw 4, located opposite to the recess 17, features an end surface 19 on its free end, which extends from the front point of impact 9 in a forward direction away from the second jaw 5 and which is offset at an angle of more than 30° in relation to the inner jaw surface 13. Correspondingly and in part symmetrically to this, the wrench jaw 5, which is equipped with the outer point of impact 16, features a slope or a rear portion 20, extending from the front point of impact 11 in a forward direction away from the first jaw 4 and offset at an angle of at least 30° in relation to the inner jaw surface 14, which slope portion forms a flank of a wall of the recess 17. The wall of the recess includes a front portion 20*a* extending back toward the first jaw 4 without crossing the plane P.

The described arrangement of the points of impact 9, 11 and 16, with each having an equal edge distance a to the adjacent edge 12 of the hexagon object 3, results in the fact that irrespective of the direction in which the open-end wrench is turned—i.e. in the first point of impact position according to FIG. 1 in both twisting directions, and in the second point of impact position in accordance with FIG. 2 in a clockwise direction—principally identical application of force conditions exist. Each time the open-end wrench grasps the edges 12 of the hexagon object, that are opposite to each other, at an edge distance a from the allocated edge 12. This helps on the one hand to avoid damaging the edges 12, and on the other hand it provides a sufficiently large lever arm for transferring the turning moment. Most suitably the edge distance a is approximately 20–25% of the length of the side surface 3*a* or 3*b* of the hexagon object 3. The edge distances b that are selected for the two rear points of impact 8 and 10 can be equal to the edge distances a, or they can be different, in particular smaller, as shown in the example in the drawing.

What is claimed is:

1. An open-ended wrench for turning a hexagonal object, the wrench comprising a handle and a wrench head disposed at an end of the handle; the wrench head forming a cavity defining an axis about which the wrench is to be rotated to turn the hexagonal object, the cavity being closed at a rear end thereof and open at a front end thereof; the front and rear ends being spaced apart in a direction extending laterally of the axis; the front end dimensioned to enable the wrench to be slipped onto and from the hexagonal object through the front end; the wrench head including first and second jaws forming a first front impact point and a second front impact point, respectively; the first and second jaws also forming a first rear impact point and a second rear impact point, respectively; the second jaw further including an outer impact point spaced from the second front impact point in a direction toward the front end of the wrench; a recess formed in the second jaw between the outer impact point and the second front impact point; the wrench being operable to receive the hexagonal object in a first orientation relative to the cavity, wherein each of the first and second front impact points is disposed to contact a respective side of the hexagonal object at a first distance from a nearest end thereof for turning the object in respective directions while the object is disposed substantially in the first orientation relative to the cavity; the wrench being further operable to receive the same hexagonal object in a second orientation, offset by 30 degrees from the first orientation, wherein a corner of the object is received in the recess, and each of the first and second front impact points, and the outer impact point are disposed to contact respective sides of the object at a second distance from the nearest end thereof; the first distance being of the same length as the second distance.

2. The wrench according to claim 1 wherein the first and second front impact points are disposed symmetrically and opposite one another.

3. The wrench according to claim 1 wherein the first and second jaws form mutually parallel first and second jaw surfaces; the first jaw surface extending between the first rear impact point to the first front contact point; the second jaw surface extending between the second rear impact point to the second front impact point.

4. The wrench according to claim 3 wherein a portion of the second jaw forming the outer point of impact faces the first jaw and avoids crossing a plane defined by the second jaw surface.

5. The wrench according to claim 3 wherein the first jaw includes an end surface extending from the first front impact point in a generally forward direction away from the second jaw at an angle no greater than 30 degrees relative to the first jaw surface.

6. The wrench according to claim 5 wherein the recess includes a rear portion extending from the second front contact point away from the first jaw at an angle no greater than 30 degrees relative to the second jaw surface.

7. The wrench according to claim 3 wherein the recess includes a sloping rear portion extending from the second front contact point away from the first jaw at an angle no greater than 30 degrees relative to the second jaw surface.

8. A method of turning a hexagonal object using a wrench comprised of a handle and a wrench head disposed at an end of the handle; the wrench head forming a cavity defining an axis about which the wrench is to be rotated to turn the hexagonal object, the cavity being closed at a rear end thereof and open at a front end thereof; the front and rear ends being spaced apart in a direction extending laterally of the axis, the front end dimensioned to enable the wrench to be slipped on and off the hexagonal object through the front end; the wrench head including first and second jaws forming a first front impact point and a second front impact point, respectively; the first and second jaws also forming a first rear impact point and a second rear impact point, respectively; the second jaw further including an outer impact point spaced from the second front impact point in a direction toward the front end of the wrench; a recess formed in the second jaw between the outer impact point and the second front impact point; the method comprising the steps of:

A) inserting the hexagonal object into the cavity at a first orientation relative thereto, wherein parallel first and second sides of the object are disposed parallel to the first and second jaws, respectively, with each of the first and second front impact points facing the respective one of the first and second sides at the same first distance from a nearest end thereof;

B) turning the object in one of a clockwise direction and a counterclockwise direction;

C) removing the wrench from the object;

D) reinserting the same hexagonal object into the cavity at a second orientation offset by 30 degrees from the first orientation, with a corner of the object disposed within the recess; wherein each of the first and second front impact points and the outer impact point is arranged to contact a respective side of the object at a second distance from a nearest end thereof, the second distance being the same as the first distance; and E) turning the object in the one of the clockwise and counterclockwise directions.

* * * * *